US007100479B2

(12) United States Patent
Seber et al.

(10) Patent No.: US 7,100,479 B2
(45) **Date of Patent: *Sep. 5, 2006**

(54) SELF-ADJUSTING PLIERS

(75) Inventors: Brett P. Seber, Escondidio, CA (US); Eric B. Carmichael, Solana Beach, CA (US)

(73) Assignee: I.D.L. Tech Tools, LLC, Summit, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/463,843

(22) Filed: Jun. 18, 2003

(65) Prior Publication Data

US 2004/0045418 A1 Mar. 11, 2004

Related U.S. Application Data

(63) Continuation of application No. 09/942,095, filed on Aug. 28, 2001, now Pat. No. 6,748,829, which is a continuation of application No. 09/594,191, filed on Jun. 14, 2000, now Pat. No. 6,279,431, which is a continuation-in-part of application No. 09/334,055, filed on Jun. 15, 1999, now Pat. No. 6,212,978.

(60) Provisional application No. 60/390,007, filed on Jun. 18, 2002.

(51) Int. Cl.
*B25B 7/04* (2006.01)

(52) U.S. Cl. ..... 81/357; 81/404

(58) Field of Classification Search ..... 81/357, 81/404, 355, 356, 358–370, 372, 381–386, 81/389, 393, 405, 408–409.5, 413
See application file for complete search history.

(56) References Cited

U.S. PATENT DOCUMENTS

| | | | | | |
|---|---|---|---|---|---|
| 2,112,873 | A | * | 4/1938 | Wright | 81/343 |
| 2,201,918 | A | | 5/1940 | Petersen | |
| 2,428,949 | A | * | 10/1947 | Ward et al. | 81/367 |
| 2,450,791 | A | | 10/1948 | Hagen | |
| 2,521,276 | A | | 9/1950 | Lampe | |
| 2,592,803 | A | | 4/1952 | Heim | |
| 3,169,307 | A | * | 2/1965 | Langwell | 81/314 |
| 3,195,382 | A | | 7/1965 | Rommel et al. | |

(Continued)

FOREIGN PATENT DOCUMENTS

FR 1264672 5/1961

*Primary Examiner*—Hadi Shakeri
(74) *Attorney, Agent, or Firm*—Lerner, David, Littenberg, Krumholz & Mentlik, LLP

(57) ABSTRACT

A self-adjusting pliers is operable to grasp a workpiece between an upper jaw and a lower jaw. The pliers includes an upper arm having a first end and a second end, with the upper jaw at the first end. A jaw arm has a first end and a second end. The second end of the jaw arm is pivotably connected to the upper arm at a main pivot adjacent to the second end of the upper arm, so that the first end of the jaw arm is movable in a circular arc relative to the main pivot. The lower jaw is at the first end of the jaw arm in movable facing relation to the upper jaw so that the workpiece may be grasped between the upper jaw and the lower jaw. An engagement mechanism releasably engages the jaw arm to the upper arm at an engagement position responsive to a movement of the jaw arm relative to the upper arm and responsive to a size of the workpiece grasped between the upper jaw and the lower jaw, to thereby prevent rotation of the jaw arm relative to the upper arm.

22 Claims, 4 Drawing Sheets

U.S. PATENT DOCUMENTS

| | | | | |
|---|---|---|---|---|
| 3,208,319 | A | | 9/1965 | Westby et al. |
| 3,241,410 | A | | 3/1966 | Paden |
| 3,379,079 | A | | 4/1968 | Cutter |
| 3,672,245 | A | | 6/1972 | Hoffman |
| 3,884,100 | A | | 5/1975 | Fideldy |
| 4,147,077 | A | | 4/1979 | Tasato |
| 4,541,312 | A | | 9/1985 | Petersen |
| 4,651,598 | A | | 3/1987 | Warheit |
| 4,662,252 | A | | 5/1987 | Warheit |
| 4,730,524 | A | | 3/1988 | Petersen |
| 4,744,272 | A | | 5/1988 | Leatherman |
| 4,802,390 | A | | 2/1989 | Warheit |
| 4,922,770 | A | | 5/1990 | Dlugolecke et al. |
| 5,020,399 | A | | 6/1991 | Annis et al. |
| 5,022,290 | A | | 6/1991 | Duffy |
| 5,351,584 | A | * | 10/1994 | Warheit ..... 81/407 |
| 5,351,585 | A | | 10/1994 | Leseberg et al. |
| 5,385,072 | A | | 1/1995 | Neff |
| 5,408,904 | A | | 4/1995 | Neff |
| 5,491,856 | A | | 2/1996 | Legg |
| 5,535,650 | A | | 7/1996 | McNatt |
| 5,609,080 | A | | 3/1997 | Flavigny |
| 6,014,917 | A | | 1/2000 | Bally et al. |
| 6,065,376 | A | * | 5/2000 | Khachatoorian ..... 81/407 |
| 6,212,978 | B1 | | 4/2001 | Seber et al. |
| 6,227,081 | B1 | * | 5/2001 | Bally et al. ..... 81/389 |
| 6,279,431 | B1 | | 8/2001 | Seber et al. |
| 6,467,380 | B1 | * | 10/2002 | Azkona ..... 81/413 |
| 6,658,971 | B1 | * | 12/2003 | Delbrugge et al. ..... 81/405 |
| 6,748,829 | B1 | | 6/2004 | Seber et al. |

* cited by examiner

SELF-ADJUSTING PLIERS

CROSS-REFERENCE TO RELATED APPLICATIONS

This application is a continuation of application Ser. No. 09/942,095, filed Aug 28, 2001, now U.S. Pat. No. 6,748,829, for which priority is claimed and whose disclosure is incorporated by reference; which is a continuation of application Ser. No. 09/594,191, filed Jun. 14, 2000, now U.S. Pat. No. 6,279,431, for which priority is claimed and whose disclosure is incorporated by reference; which in turn is a continuation-in part of application Ser. No. 09/334,055, filed Jun. 15, 1999, now U.S. Pat. No. 6,212,978, for which priority is claimed and whose disclosure is incorporated by reference. This application also claims the benefit of U.S. Provisional Application No. 60/390,007, filed Jun. 18, 2002, whose disclosure is incorporated herein by reference.

FIELD OF THE INVENTION

This invention relates to pliers, and, more particularly, to a self-adjusting pliers that grips workpieces of various sizes without manual adjustment.

BACKGROUND OF THE INVENTION

The traditional version of a pliers includes two elongated members joined at a pivot pin. One end of each elongated member forms a jaw, and the other end forms a handle. Workpieces of different sizes are grasped in different manners, due to the constant geometry of the elongated members and the jaws. Some adjustability may be achieved by providing a slotted receiver in one of the handles, so that the handle with the pivot pin may be moved between different positions in the slot to provide adjustability for gripping objects of different sizes.

U.S. Pat. No. 4,651,598 provides an improved pliers whose jaws are self adjusting according to the size of the workpiece. Commercial versions of this pliers are useful, but have significant drawbacks. Perhaps the most significant problem with the pliers made according to the '598 patent is that the jaws move slightly relative to each other in an end-to-end manner as they are clamped down onto a workpiece. The surfaces of soft workpieces such as brass or copper may be marred as a result. The clamping force applied by these pliers depends upon the size of the workpiece being grasped.

Another problem with the pliers of the '598 patent is that they do not lock to the workpiece, an important convenience in some uses of pliers. Overcenter locking pliers are described in a series of patents such as U.S. Pat. No. 4,541,312. Conventional overcenter locking pliers provide adjustability in the size of the workpiece that may be gripped through a screw adjustment to the pivoting position of the control arm, but this adjustability is not automatic in the sense of the pliers of the '598 patent.

Other types of locking pliers such as the AutoLock™ pliers combine the self-adjusting feature with an overcenter locking mechanism. This pliers can be inconvenient to use for some sizes of workpieces, suffers from some of the problems of the pliers of the '598 patent, does not achieve a large gripping force, and may unexpectedly unlock when large objects are being gripped. Additionally, as with some other pliers, two hands are required for its operation.

There is a need for a self-adjusting pliers which does not experience shifting of the jaw position as the object is grasped, which may be operated with one hand, and which may be provided in a locking version. The present invention fulfills this need.

SUMMARY OF THE INVENTION

The present invention provides a self-adjusting pliers wherein the jaws automatically adjust to various sizes of workpieces. There is no end-to-end relative movement of the jaws as they grasp the workpiece, so that there can be no surface marring of the type observed with the pliers of the '598 patent. The clamping force is substantially constant regardless of the size of the workpiece, but is adjustable in some versions of the pliers. The clamping force against the workpiece is multiplied several times by the mechanism, leading to a much higher maximum available clamping force than possible with conventional pliers. The pliers may be provided with no locking or with releasable overcenter locking, or with the ability to switch between the two. The self-adjusting pliers is operable with one hand.

In accordance with the invention, a self-adjusting pliers is operable to grasp a workpiece between an upper jaw and a lower jaw. The pliers includes an upper arm having a first end and a second end. The upper jaw is at the first end of the upper arm. A jaw arm has a first end and a second end. The second end of the jaw arm is pivotably connected to the upper arm at a main pivot adjacent to the second end of the upper arm, so that the first end of the jaw arm is movable in a circular arc relative to the main pivot. The lower jaw is located at the first end of the jaw arm in movable facing relation to the upper jaw as the jaw arm pivots about the main pivot, so that the workpiece may be grasped between the upper jaw and the lower jaw. An engagement mechanism releasably engages the jaw arm to the upper arm at an engagement position responsive to a movement of the jaw arm relative to the upper arm and responsive to a size of the workpiece grasped between the upper jaw and the lower jaw. Further gross rotation of the jaw arm relative to the upper arm is thereby prevented until the engagement to the workpiece is released. The upper jaw and the lower jaw are each preferably of a multilayer metallic construction.

Preferably, there is a support integral with, and extending from the upper arm toward and past the jaw arm. The support includes a support engagement curved in a circular arc centered about the main pivot. The support engagement desirably includes an engagement slot or channel in the support, and a restraining plate to restrain, guide, position, and align some of the components of the engagement mechanism. There is additionally a lower arm that is linked to the jaw arm at a location adjacent to the lower jaw, but that is not integral with the jaw arm. A control arm has a first end and a second end. The first end of the control arm is pivotably connected to the jaw arm at an upper control-arm pivot pin adjacent to the second end of the jaw arm. The second end of the control arm is pivotably connected to the lower arm at a lower control-arm pivot pin at a location along the length of the lower arm. A lower-arm spring biases the lower arm so as to resist rotation of the lower arm about the upper control-arm pivot pin.

The engagement mechanism desirably includes a shifter and a pawl that is pivotably supported on the shifter. The shifter is operable to engage the pawl to the upper arm, and specifically to the downwardly extending support, at the engagement position responsive to the movement of the jaw arm relative to the upper arm and responsive to the size of the workpiece grasped between the upper jaw and the lower jaw. The shifter transmits a locking and engaging force applied through the lower arm to the lower jaw and also engages the pawl to the support engagement slot responsive to the movement of the jaw arm relative to the upper arm and responsive to the size of the workpiece grasped between the upper jaw and the lower jaw. The shifter is pivotable relative to the jaw arm and is rotatable relative to the lower arm, and the pawl is pivotably supported on the shifter.

The engagement mechanism releasably engages the jaw arm to the upper arm. There may also be a locking mechanism that releasably locks the jaw arm to the upper arm, and specifically to the downwardly extending support, at the engagement position. Some versions of the pliers are controllably alterable between the releasable-engagement type and the releasable engagement-and-lock type by the operation of a locking engagement control. In one design, a locking-engagement control of the locking mechanism interferes with a rotation of the control arm about the upper control-arm pivot pin in the releasable-engagement embodiment, and the locking engagement control does not interfere with a rotation of the control arm about-the upper control-arm pivot pin in the releasable engagement-and-lock embodiment.

In one form, the pliers includes a releasable overcenter lock for the jaws. In this version, there is a downwardly extending lobe on the control arm. A release arm is pivotably connected to the lower arm and has a release pad disposed to contact the lobe of the control arm when the release arm is pivoted. In operation, the control arm moves to an overcenter position when the clamping force is fully applied. This overcenter position may be released to unlock the jaws from the workpiece either by pulling the handles apart, or by manually pivoting the release arm. The overcenter locking is readily released by pulling the upper arm and the lower arm apart when the clamping force is small, but is more conveniently released by operating the release arm when the clamping force is large.

In another version, the pliers is controllably switchable between a nonlocking function and a locking function. An overcenter lock switch mechanism in the lower handle is movable between a first position whereat the overcenter lock switch mechanism does not prevent pivoting movement of the lower arm relative to the control arm prior to reaching an overcenter lock, and a second position whereat the overcenter lock switch mechanism does prevent pivoting movement of the lower arm relative to the control arm prior to reaching an overcenter lock. The movement of the locking switch mechanism to the second position prevents the pivoting movement of the lower arm and the control arm to an overcenter locking position, and thereby prevents this overcenter locking function. Thus, there may be nonlocking-only, locking-only, or switchable embodiments of the pliers that may be switched between the nonlocking and locking forms.

The maximum magnitude of the clamping force applied to the workpiece maybe much larger than possible with conventional pliers, due to a force multiplication effect present in the mechanism. The length of the arms, the angle between the control arm and the lower arm, the relative location of the shifter pivot points, and the movement of the shifter relative to the jaw mechanism all contribute to a leveraged multiplication of the force applied though the handles. The multiplication factors are established by the structural geometry built into the pliers.

The pliers may be provided with control over the clamping force applied to the workpiece through the jaws. A manual force adjuster acting on the control arm is provided at a location adjacent to the second end of the upper arm. The manual force adjuster is operable to move the upper control-arm pivot pin along the jaw arm. This movement of the pivot point of the first end of the control arm changes its angle and position relative to the lower arm and to the jaw arm, with the result that the maximum clamping force applied through the jaws is controllably variable. It is preferred to combine the features of both the manual force adjuster and the releasable overcenter lock in a single pliers, when either feature is provided.

In operation, with the jaws separated and not contacting the workpiece, the jaw arm, the lower arm, the control arm, and the engagement mechanism initially rotate relative to the upper arm as an interconnected unit about the main pivot. An anti-squat mechanism aids in maintaining the fixed geometrical relationship of these elements during the initial rotation. A main spring reacts between this interconnected unit and the upper arm, and specifically between the jaw arm and the upper arm. The main spring weakly biases the interconnected unit away from the upper arm to initially keep the jaws separated. The hand force applied by the user through the upper arm and the lower arm overcomes this biasing to move the jaws toward contact with the workpiece. When the jaws contact the workpiece, the shifter begins to rotate to apply the hand force of the user to the workpiece as the clamping force. As the contact pressure increases further, the force multiplication effect comes into play to produce a clamping force that is greater than the user would otherwise produce. The workpiece is thereby clamped between the jaws with a maximum clamping force that is controllable through the force adjuster. Release of the hand force by the user reverses the process. If the pliers is the locking embodiment or the switchable embodiment operated in the locking mode, the lock automatically engages to hold the workpiece securely even though the user relaxes the force applied through the upper arm and the lower arm. The locking may be unlocked by operating the release arm.

The mechanism of the invention is operable to move the lower jaw upwardly along the downwardly extending guide until the lower jaw contacts the workpiece, and to then engage the jaw arm to the upper arm and to transfer a clamping force to the lower jaw. The clamping mechanism is thus self-adjusting to accommodate any size workpiece that will fit between the jaws. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
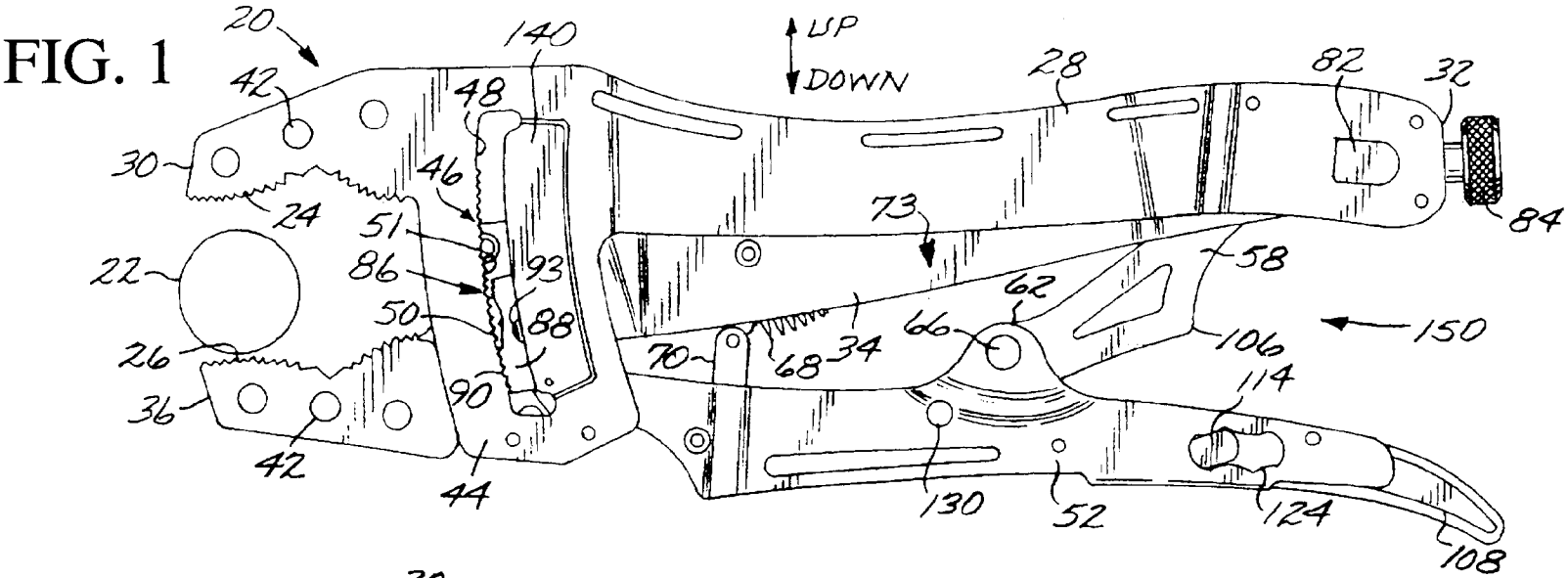
FIG. 1 is an elevational view of a pliers.
Figure 3:
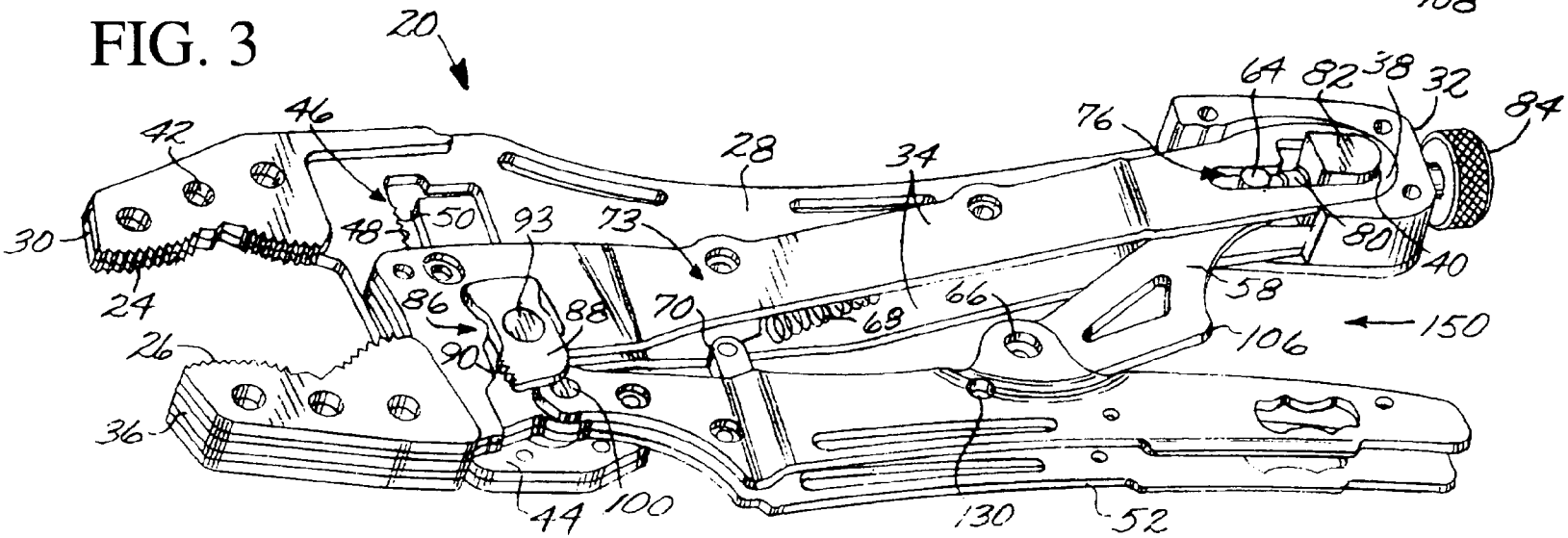
FIG. 3 is a schematic perspective view of the pliers of FIG. 1, with additional portions of the external structure removed.
Figure 2:
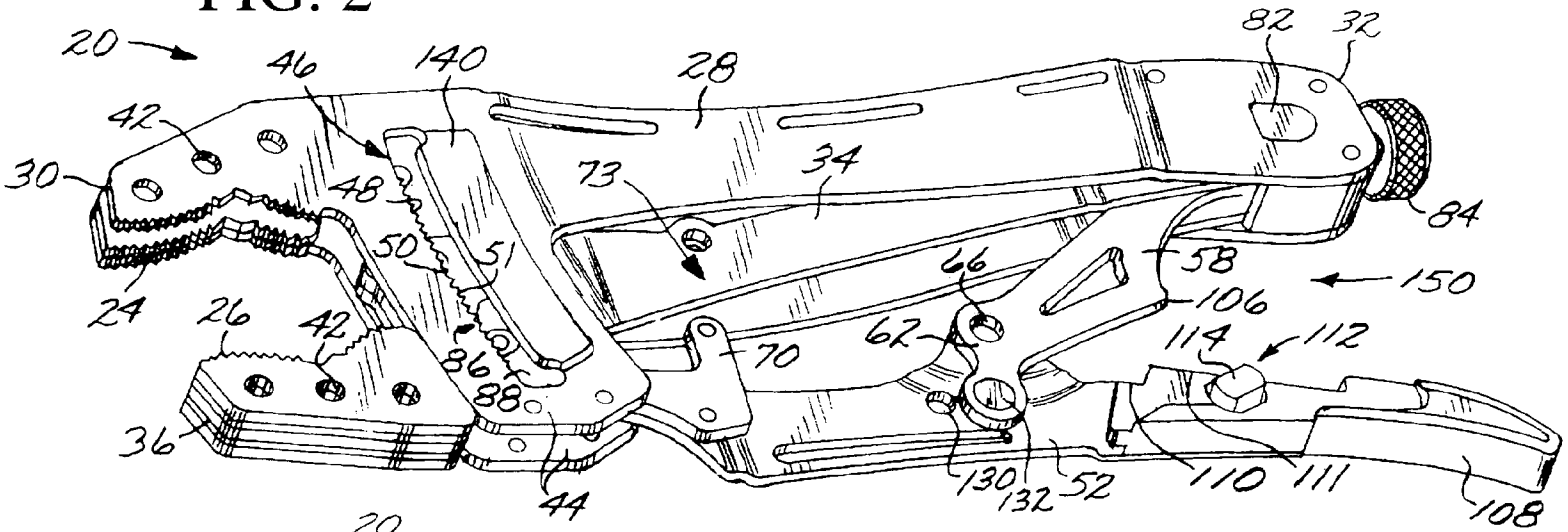
FIG. 2 is a schematic perspective view of the pliers of FIG. 1, with portions of the external structure removed.
Figure 4:
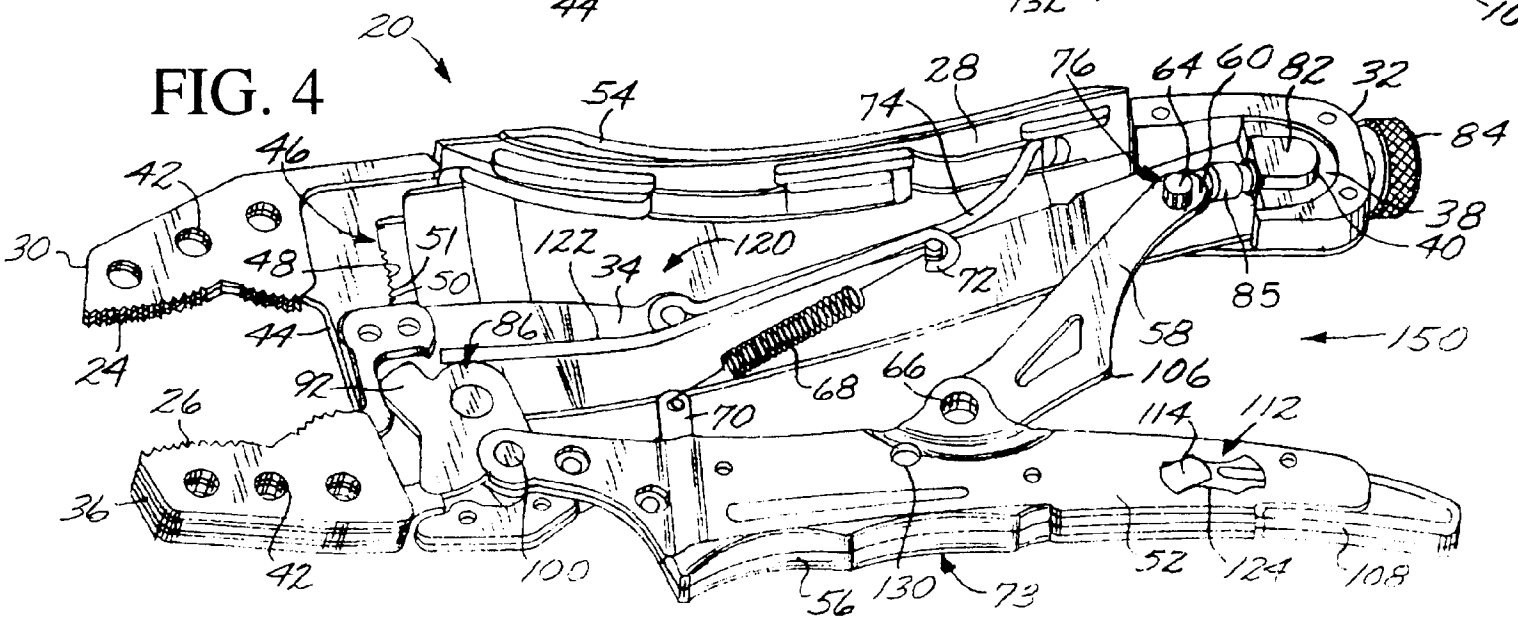
FIG. 4 is a schematic perspective view of the pliers of FIG. 1, with further portions of the external structure removed.
Figure 5:
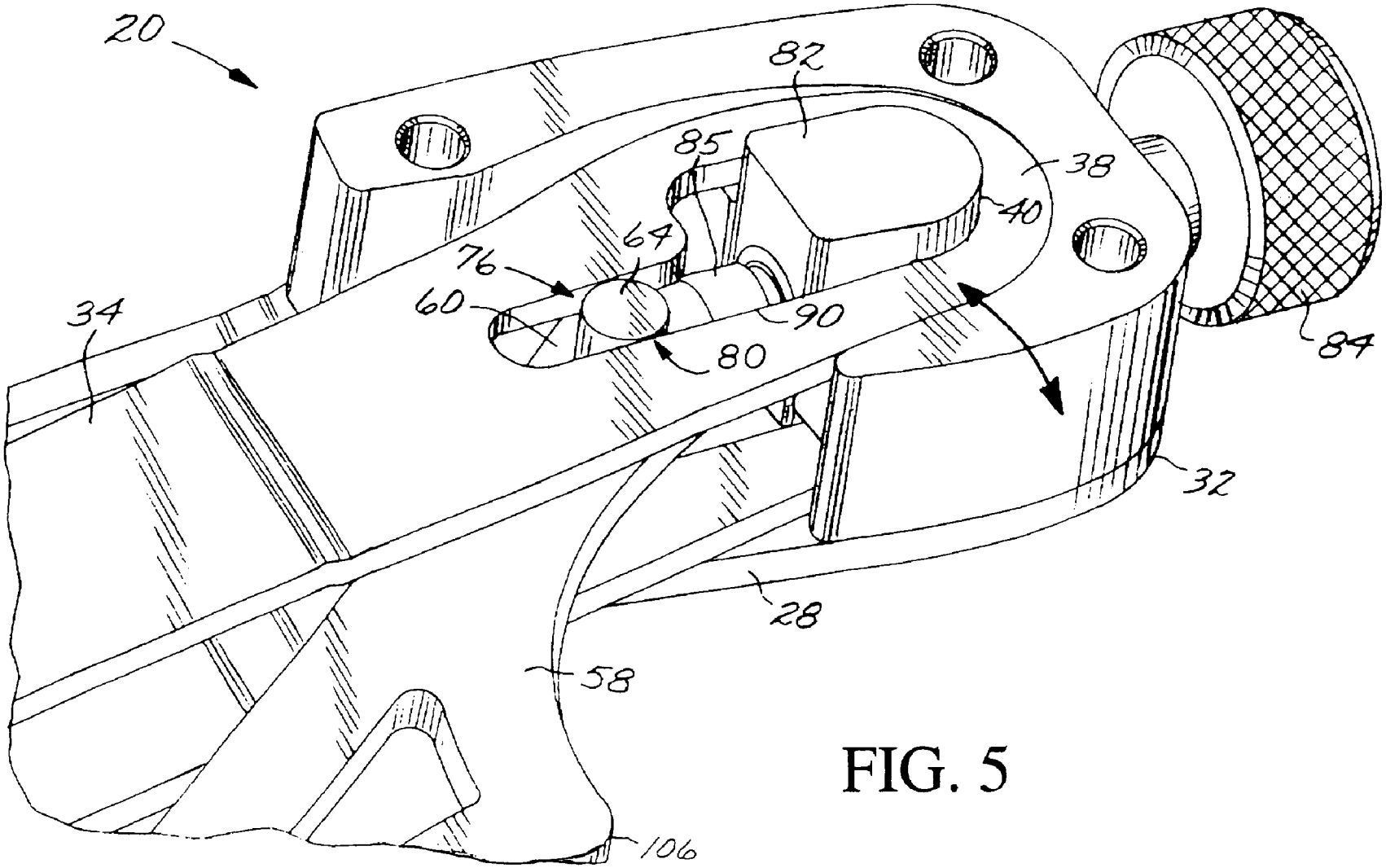
FIG. 5 is a detail perspective view near the second end of the upper arm of the pliers of FIG. 1.
Figure 6:
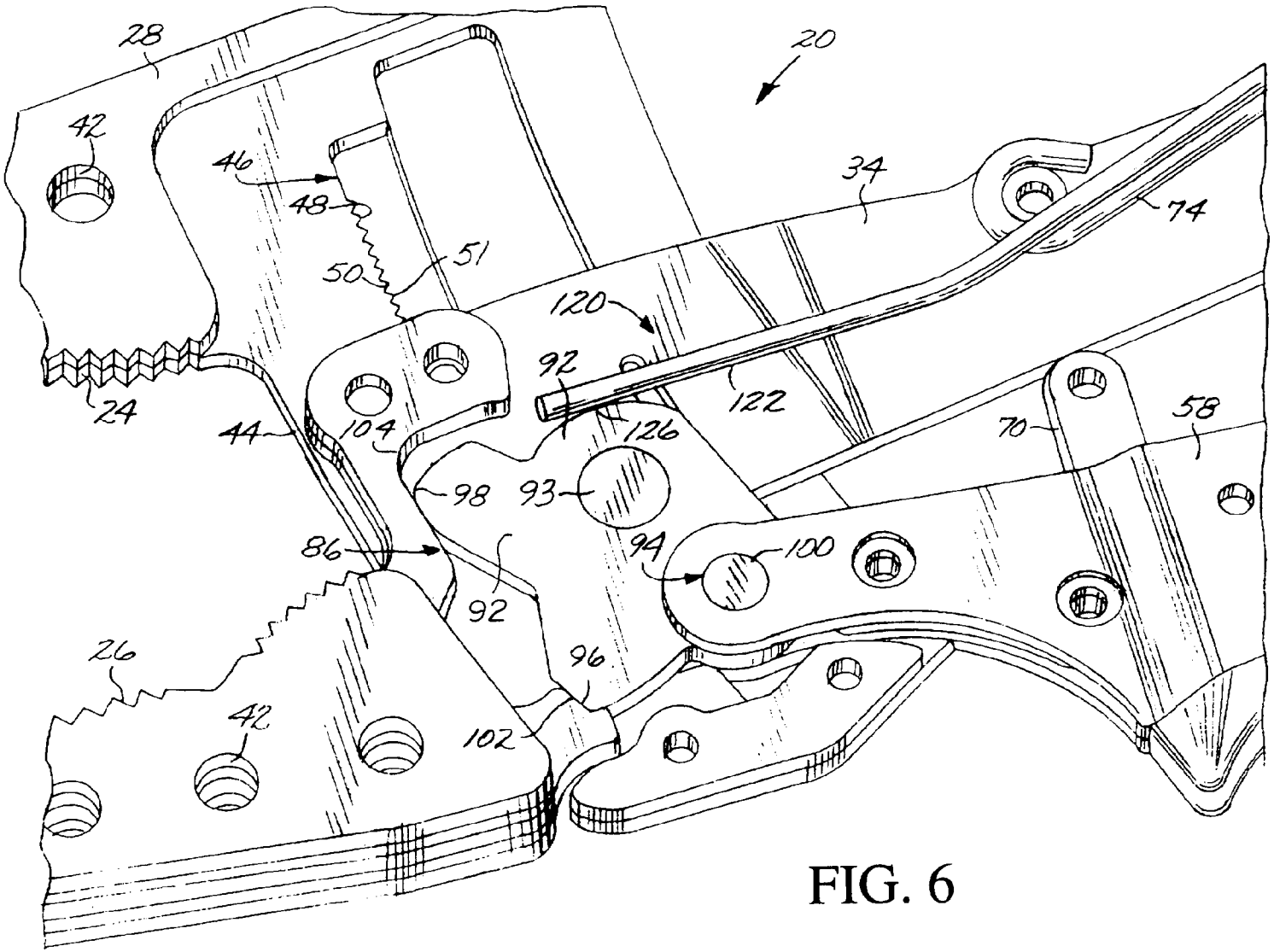
FIG. 6 is a detail perspective view in the region of the shifter of the pliers of FIG. 1.

FIGS. 1–6 illustrate a self-adjusting pliers 20 according to the invention. FIG. 1 is an elevational view, and FIGS. 2–4 show the same pliers 20 with portions of the structure progressively removed to illustrate the internal structure and mechanics. FIGS. 5–6 are details. "Up" and "down" reference directions are indicated on several of the figures and apply to all of the embodiments. In the figures, rivets that are present to hold the structure together are not shown because their heads tend to obscure the views of the relevant structure. The appropriate rivet holes are visible.

As illustrated in FIG. 1, the self-adjusting pliers 20 is a hand tool that is operable to grasp a workpiece 22 between an upper jaw 24 and a lower jaw 26. An upper arm 28 has a first end 30 and a second end 32. The upper jaw 24 is at the first end 30 of the upper arm 28, and is integral with the remainder of the upper arm 28 in the depicted embodiment.

As best seen in FIG. 3, a jaw arm 34 has a first end 36 and a second end 38. The second end 38 of the jaw arm 34 is pivotable relative to the upper arm 28 on a main pivot 40 adjacent to the second end 32 of the upper arm 28. The main pivot 40 is a segment of a circle defined on a pivot block 82 that is fixedly supported between the sides of the upper arm 28. The first end 36 of the jaw arm 34 is therefore movable in a circular arc relative to the center defined by the main pivot 40. The upper arm 28 is a generally U-shaped channel over most of its length with the opening of the U facing downwardly, so that the jaw arm 34 may be received between the sides of the upper arm 28 as the jaw arm 34 pivots. The lower jaw 26 is at the first end 36 of the jaw arm 34 in movable facing relation to the upper jaw 24. As the jaw arm 34 pivots about the main pivot 40, reducing the distance between the jaws 24 and 26, the workpiece 22 is grasped between the upper jaw 24 and the lower jaw 26. As seen in FIGS. 2–4, in the preferred embodiment the upper jaw 24 and the lower jaw 26 are each preferably of a multilayer metallic construction. That is, each of the jaws 24 and 26 is made by stacking appropriately shaped thin metallic plates, and attaching them together with rivets extending through transverse rivet holes 42 in the jaws 24 and 26. Similarly, in this embodiment the arms are made of overlying plates. In other embodiments, the jaws may be made of solid, non-laminated metal, and some of the arms may be made as a single piece of metal formed into a U-shaped channel, as appropriate.

A support 44 is integral with and extends downwardly from the upper arm 28 toward and past the jaw arm 34. The support 44 includes a support engagement 46 therein, curved in a circular arc centered about the center of the main pivot 40. The support engagement 46 is preferably a support engagement slot 48. The support engagement slot 48 desirably includes small support engagement teeth 50 along a side 51 of the slot 48 nearest the jaws 24 and 26.

A lower arm 52 is linked to the jaw arm 34 at a location adjacent to the lower jaw 26. The lower arm 52 is not integral with the jaw arm 34. The lower arm 52 extends generally parallel to the upper arm 28. The upper arm 28 and the lower arm 52 are grasped by the hand of the user of the pliers 20, and an upper arm pad 54 and a lower arm pad 56 are provided in their outwardly facing surfaces to facilitate this grasping and aid in the user positioning the grasping hand correctly. The upper arm 28 and the lower arm 52 thereby serve as the handles grasped by the user of the pliers 20.

A control arm 58 has a first end 60 and a second end 62. The first end 60 of the control arm 58 is pivotably connected to the jaw arm 34 at an upper control-arm pivot pin 64 adjacent to the second end 38 of the jaw arm 34. The upper control-arm pivot pin 64 extends between the sides of the jaw arm 34. The second end 62 of the control arm 58 is pivotably connected to the lower arm 52 at a lower control-arm pivot point 66 that is positioned at a location, in this case an intermediate location, along the length of the lower arm 52.

A lower-arm spring 68 biases the lower arm 52 so as to resist rotation of the lower arm 52 about the upper control arm pivot point 64. In the illustrated embodiment, the lower-arm spring 68 is a coil spring connected between a projection 70 on the lower arm 52 and an intermediate location 72 on the jaw arm 34.

In operation, the jaw arm 34, the lower arm 52, the control arm 58, and an engagement mechanism initially rotate relative to the upper arm 28 as an interconnected unit 73 about the main pivot 40. A main spring 74, illustrated as a main leaf spring, reacts between this interconnected unit 73 and the upper arm 28, and specifically between the jaw arm 34 and the upper arm 28. The main leaf spring 74 biases the interconnected unit 73 away from the upper arm 28, so that the jaws 24 and 26 are normally spread apart to receive the workpiece 22 therebetween. The squeezing hand force of the user grasping the upper arm 28 through the upper arm pad 54, and the lower arm 52 through the lower arm pad 56, overcomes this biasing force of the main leaf spring 74 to achieve the initial contact and initial grasping of the workpiece 22 between the jaws 24 and 26.

In the preferred form of the pliers 20, the upper control-arm pivot pin 64 is selectively movable generally (but not precisely) parallel to a line extending between the first end 30 and the second end 32 of the upper arm 28. This movement serves to adjust the maximum clamping force exerted by the jaws 24 and 26 on the workpiece 22, when the workpiece 22 is clamped between the jaws 24 and 26, by changing the geometry of the linkage between the jaw arm 34, the lower arm 52, and the control arm 58. The movement and adjustability are achieved by slidably supporting the upper control arm pivot pin 64 in a pin slot 80 in the jaw arm 34.

As best seen in FIG. 5, a force adjuster 84 extends from the second end 32 of the upper arm 28. The force adjuster 84 is a knob, preferably a knurled knob, accessible to the fingers of the user of the pliers and having an integral threaded shaft 85 that extends through and is threadably engaged to the pivot block 82. An end of the threaded shaft 85 remote from the force adjuster 84 has a dome shape that is forced against the upper control-arm pivot pin 64. When the force adjuster 84 is turned, the shaft 85 drives the upper control-arm pivot pin 64 along the pin slot 80, in a direction generally (but not exactly) parallel to the line extending between the first end 30 and the second end 32 of the upper arm 28.

An engagement mechanism 86 releasably engages the jaw arm 34 to the upper arm 28, and specifically to the support engagement 46 of the support 44. The releasable engagement is made at an engagement position responsive to a movement of the jaw arm 34 relative to the upper arm 28 and responsive to a size of the workpiece 22 grasped between the upper jaw 24 and the lower jaw 26. (As will be discussed, the preferred engagement mechanism 86 includes a shifter and a pawl, and their related structure.) This engagement prevents further gross rotation of the jaw arm 34 and the remainder of the interconnected unit 73 relative to the upper arm 28 when the workpiece 22 is so grasped with the clamping force determined by the position of the upper control-arm pivot pin 64 in the pin slot 80, although there is a further minor rotation of the jaw arm 34. That is, when the jaws 24 and 26 are separated further than the size of the workpiece 22, the force of the hand of the user on the pads 54 and 56 causes the jaws 24 and 26 to close to contact the workpiece 22 by the rotation of the interconnected unit 73 relative to the upper arm 28 about the main pivot 40. When the jaws 24 and 26 contact the workpiece 22 and as there is an initial application of a small clamping force to the workpiece 22, the engagement mechanism 86 automatically operates to engage the jaw arm 34 and the interconnected unit 73 to the support 44 and thence to the upper arm 28, so that there is no further gross rotation of the interconnected unit 73. The pliers 20 is thereby automatically adjustable to the size of the workpiece 22 being grasped.

The engagement mechanism 86 includes a pivotably supported pawl 88. The pawl 88 rides on the jaw arm 34 in the support engagement slot 48 in facing relation to the support engagement teeth 50. The pawl 88 has pawl teeth 90 thereon. Prior to engagement, the pawl 88 is separated from a side 51 of the support engagement slot 48 that is nearest the jaws 24 and 26. During engagement, the pawl 88 is moved into contact with the side 51 so that the pawl teeth 90 mesh with the support engagement teeth 50 to prevent further upward gross motion of the jaw arm 34. A restraining plate 140 overlies a portion of the pawl 88, holds the pawl on its pawl pivot pin 93, and serves to align and guide the movement of the pawl 88.

The engagement mechanism 86 also includes the shifter 92. The shifter 92, shown in detail in FIG. 6, transfers the force applied to the lower arm 52 by the hand of the user, from the lower arm 52 to the lower jaw 26. Additionally, the shifter 92 pivotably supports the pawl 88 on the pawl pivot pin 93 that extends through the shifter 92 and the pawl 88, activates the pawl 88, and engages the pawl 88 to the support 44 of the upper arm 28 when the workpiece 22 is contacted by the jaws 24 and 26. This engagement is responsive to the movement of the jaw arm 34 relative to the upper arm 28 and responsive to the size of the workpiece 22 grasped between the upper jaw 24 and the lower jaw 26.

The shifter 92 is in the form of a thin plate that transfers force. The shifter 92 has three pivot points, including the pawl pivot pin 93, a pinned pivot point 94, and a contact face 98 thereon arranged in a triangular pattern. The pawl pivot pin 93 becomes a pivot point after the pawl 88 is engaged to the support 44, but not prior to that engagement. The pivot point 94 is pivotably connected by a pin to the lower arm 52 at a shifter pin pivot 100. The contact face 98 pivots and slides against, but is not pinned to, the jaw arm 34 at a contact face 104. The pawl 88 is pivotably connected to the central portion of the shifter 92 at the pawl pivot pin 93. (The pawl 88 is not shown in FIGS. 4 and 6, because it would obscure the view of the shifter 92, but it is shown in FIG. 3.) The shifter 92 thereby provides the force transfer between the lower arm 52, the pawl 88, and the lower jaw 26. That is, the lower jaw 26 is not integral with the lower arm 52, but instead is linked to it by a linkage provided by the shifter 92, in this embodiment.

In operation, starting with the jaws 24 and 26 at their greatest separation, the user grasps the upper arm 28 and the lower arm 52 and moves them toward each other. The interconnected unit 73 rotates relative to the upper arm 28 as a rigid interconnected structure around the main pivot 40. The geometric relationships of the elements of the interconnected unit 73, including the jaw arm 34, the lower arm 52, the control arm 58, and the engagement mechanism 86, is kept rigid by means of an anti-squat mechanism 120 during this initial rotation. The anti-squat mechanism 120 includes the contact face 96 of the shifter 92, and the contact face 102 of the lower jaw 26. An anti-squat spring 122, illustrated as an anti-squat leaf spring, reacting against an upper surface 126 of the shifter 92, holds the contact faces 96 and 102 in contact during this period of rotation of the interconnected unit 73. By keeping the contact faces of 102 and 96 in contact until the lower jaw 26 and the upper jaw face 24 contact the work piece 22, the antisquat mechanism 120 keeps the interconnected unit 73 geometrically rigid until the jaws 24 and 26 touch and begin to apply force to the work piece 22, and additionally prevents the rotation of the shifter 92.

After the jaws 24 and 26 have contacted the workpiece 22 and begun to apply a contact force into the workpiece 22, the contact face 96 lifts up and away from the contact face 102 that is part of the lower jaw 26, against the biasing force of the antisquat leaf spring 122. The shifter 92 rotates clockwise (in the view of the drawings) about the pivot established between the contact surface 98 and the contact face 104. The pawl 88 rotates clockwise about the pawl pivot pin 93 and moves toward the lower jaw 26 to engage the pawl teeth 90 to the support engagement teeth 50. This engagement of the pawl teeth 90 to the support engagement teeth 50 halts further gross rotation and motion of the interconnected unit 73.

For most applications, it is desirable that the contacting force of the jaws 24 and 26 to the workpiece 22 be large in order to ensure that the workpiece is firmly held. To accomplish that result, the shifter achieves a force-multiplier effect wherein the contact force applied to the workpiece 22 is significantly greater than the force produced by the grasping action of the hand of the user. With the illustrated design, the force multiplier is on the order of about 3–4 when friction and other effects are considered, although higher force multipliers are possible in other designs. The force multiplication arises as follows. Once the pawl teeth 90 are engaged to the support engagement teeth 50, the rotational pivot point of the shifter 92 is transferred from the contact face 98 of the shifter 92 to the pawl pivot pin 93. The contact face 98 rides on the inclined contact face 104. The shifter 92 continues to rotate about the pivot pin 93 as the lower arm 52 is moved toward the upper arm 28, producing a further minor rotation of the jaw arm 34. The hand force of the user moving over a longer distance is transferred into the lower jaw 26, which moves a shorter distance but with greater contact force applied to the workpiece 22, than the hand force of the user. The force multiplication is achieved because the contact faces 98 and 104 act as an inclined plane as the shifter 92 rotates. The difference in the length of the lever arm between the locations 93–98 and 93–94 also contributes to the force multiplication.

The release of the force on the lower arm 52 reverses this process, causes the shifter 92 to rotate counterclockwise, disengages the pawl teeth 90 from the engagement teeth 50, allows the lower jaw 26 to move downwardly, and disengages the jaws 24 and 26 from the workpiece 22.

In the use of the pliers 20 just discussed, the jaws 24 and 26 engage and hold the workpiece 22 such that release of the pressure applied to the upper arm 28 and the lower arm 52 immediately releases the workpiece 22. In another embodiment, the jaws 24, 26 may be engaged to the workpiece 22 and releasably locked to the workpiece 22 by a locking mechanism 150, which in this case is an overcenter locking mechanism.

The overcenter locking mechanism 150 with its associated release are conveniently provided by placement of an unlocking lobe 106 on the lower side of the control arm 58. A release arm 108 is pivotably connected to the lower arm 52 and accessible to the hand of the user of the pliers 20 at the end of the lower arm 52 remote from the shifter 92. A release pad 110 on the upper side of the release arm 108 is disposed to contact the unlocking lobe 106 when the release arm 108 is rotated. In operation, the lower control arm pivot point 66 moves to an overcenter position relative to the upper control-arm pivot pin 64 and the pivot pin 94, when the lower arm 52 is moved upwardly to the limit of its travel established by the operation of the engagement mechanism 86. Stated alternatively, when the lower arm 52 is fully open (moved to its downward limit of travel) as in FIG. 1, the lower control arm pivot point 66 lies below a straight line drawn between the upper contact-arm pivot pin 64 and the pivot point 94. As the lower arm 52 is moved upwardly, the lower control arm pivot point 66 moves closer to a straight-line relationship between the pivot pins 64 and 94, and eventually crosses over that straight line to lie above the straight line drawn between the pivot pins 64 and 94. This is the overcenter lock position. To release the pliers 20 from this overcenter lock position, the release arm 108 is operated to rotate the release pad 110 upwardly against the unlocking lobe 106, and thereby force the lower arm 52 downwardly and out of the overcenter relationship.

This type of overcenter locking capability may be provided instead of or in addition to the engaging-but-nonlocking embodiment described previously. The embodiment of FIGS. 1–4 allows the pliers 20 to be selectively shifted between the non-locking version and the locking/release version. A locking engagement control 112 includes an overcenter lock selector 114. The overcenter lock selector 114 selectively moves the release arm 108 in a track 124 to a position wherein an overcenter blocking pad 111 on the release arm 108 contacts the unlocking lobe 106 to block the movement of the control arm 58 that is required to reach the overcenter locked position. In this position, the pliers 20 functions to grasp the workpiece 22 between the jaws 24 and 26, but does not lock the jaws 24 and 26 against the workpiece 22. When the force is released from the arms 28 and 52, the workpiece 22 is released. On the other hand, when the overcenter lock selector 114 is repositioned to move the release arm 108 in the track 124 so that the overcenter blocking pad 111 does not block the movement of the control arm 58 that is required to reach the overcenter locked position, the force on the arms 28 and 52 causes the jaws 24 and 26 first to grasp and, then with continued force, to lock onto the workpiece 22. Release of the force on the arms 28 and 52 does not itself cause the jaws 24 and 26 to release from the workpiece 22. Instead, the release arm 108 is pivoted to contact the unlocking lobe 106 and push the lower arm 52 away from the control arm 58. The contacting force applied by the jaws 24 and 26 to the workpiece 22 is released, and the disengagement of the jaws 24 and 26 from the workpiece proceeds. The ability to readily switch between nonlocking and locking pliers is an important advantage of one embodiment of the present approach.

For either the engaging-only or the engaging-and-locking embodiments, it is often helpful to know whether the maximum permissible clamping force, as determined by the position of the upper contact-arm pivot pin 64, has been applied through the jaws 24 and 26 to the workpiece 22. In the presently preferred approach, a force indicator window 130 is provided through each of the sides of the lower arm 52. When the control arm 58 has been sufficiently rotated to correspond to the maximum permissible clamping force, a force indicator 132 is visible through the force indicator window 130. The force indicator 132 is preferably a region of contrasting color on a projection on the side of the control arm 58, for example, a yellow force indicator 132 on a black metallic control arm 58. If the control arm 58 is only partially rotated toward the position associated with less than the maximum contact force on the workpiece 22, the force indicator 132 is not visible thorough the force indicator window 130. If the control arm 58 is fully rotated to the position associated with the maximum contact force on the workpiece 22, the force indicator 132 is visible through the force indicator window 130, giving an indication of this force status to the user of the pliers 20.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. Self-adjusting pliers having upper and lower jaws for grasping a workpiece and upper and lower arms for grasping by the hand of a user, comprising:

the upper arm having a first end and a second end, wherein the upper jaw is at the first end of the upper arm;

a jaw arm having a first end and a second end, wherein the second end of the jaw arm is pivotably connected to the upper arm at a main pivot adjacent to the second end of the upper arm, so that the first end of the jaw arm is movable in a circular arc relative to the main pivot, and wherein the lower jaw is at the first end of the jaw arm in movable facing relation to the upper jaw so that the workpiece may be grasped between the upper jaw and the lower jaw;

the lower arm linked to the jaw arm at a location adjacent the lower jaw but not integral with the jaw arm;

an engagement mechanism that, upon the user's squeezing together of the upper arm and the lower arm, releasably engages the jaw arm, lower jaw and the lower arm to the upper arm and the upper jaw, said engagement mechanism being responsive to a movement of the jaw arm relative to the upper arm and to a size of the workpiece grasped between the upper jaw and the lower jaw; and a support integral with and extending from the upper arm toward and past the jaw arm, the support including a support engagement curved in a circular arc centered about the main pivot, a control arm having a first end and a second end, wherein the first end of the control arm is pivotably connected to the jaw arm at an upper control-arm pivot pin adjacent to the second end of the jaw arm, and wherein the second end of the control arm is pivotably connected to the lower arm at a lower control-arm pivot point at a location along the length of the lower arm, and a lower-arm spring biasing the lower arm so as to resist rotation of the lower arm about the upper control-arm pivot pin.

2. The pliers of claim 1, wherein the upper jaw and the lower jaw are each of a multilayer metallic construction.

3. The pliers of claim 1, wherein the upper control-arm pivot pin is selectively movable generally parallel to a line extending between the first end and the second end of the upper arm.

4. The pliers of claim 1, further including a force adjuster that selectively moves the upper control-arm pivot pin generally parallel to a line extending between the first end and the second end of the upper arm.

5. The pliers of claim 1, wherein the jaw arm, the control arm, the lower arm, and the engagement mechanism constitute an interconnected unit, and wherein the pliers further includes a main spring reacting between the interconnected unit and the upper arm.

6. The pliers of claim 1, wherein the engagement mechanism includes a pivotably supported pawl, and a shifter upon which the pawl is pivotably supported and which is operable to engage the pawl to the upper arm responsive to the movement of the jaw arm relative to the upper arm and responsive to the size of the workpiece grasped between the upper jaw and the lower jaw.

7. The pliers of claim 1, further including a locking mechanism which releasably locks the jaw arm to the upper arm at the engagement position.

8. The pliers of claim 1, wherein the pliers has no locking mechanism which releasably locks the jaw arm to the upper arm at the engagement position.

9. The pliers of claim 7, further including a locking engagement control operable to alter the pliers between a releasable engagement and a releasable engagement-and-lock.

10. A self-adjusting pliers operable to grasp a workpiece between an upper jaw and a lower jaw, comprising:

an upper arm having a first end and a second end, wherein the upper jaw is at the first end of the upper arm;

a jaw arm having a first end and a second end, wherein the second end of the jaw arm is pivotably connected to the upper arm at a main pivot adjacent to the second end of the upper arm, so that the first end of the jaw arm is movable in a circular arc relative to the main pivot; and wherein the lower jaw is at the first end of the jaw arm in movable facing relation to the upper jaw so that the workpiece may be grasped between the upper jaw and the lower jaw;

a support integral with and extending from the upper arm toward and past the jaw arm, the support including a support engagement slot curved in a circular arc centered about the main pivot;

a lower arm, wherein the lower arm is linked to the jaw arm at a location adjacent to the lower jaw, but is not integral with the jaw arm;

a control arm having a first end and a second end, wherein the first end of the control arm is pivotably connected to the jaw arm at an upper control-arm pivot pin, and wherein the second end of the control arm is pivotably connected to the lower arm at a lower control-arm pivot point at a location along the length of the lower arm;

a lower-arm spring biasing the lower arm so as to resist rotation of the lower arm about the main pivot; and an engagement mechanism that releasably engages the jaw arm to the upper arm at an engagement position responsive to a movement of the jaw arm relative to the upper arm and responsive to a size of the workpiece grasped between the upper jaw and the lower jaw.

11. The pliers of claim 10, wherein the upper jaw and the lower jaw are each of a multilayer metallic construction.

12. The pliers of claim 10, wherein the upper jaw and the lower jaw are each of a solid, non-multilayer metallic construction.

13. The pliers of claim 10, wherein the upper control-arm pivot pin is selectively movable generally parallel to a line extending between the first end and the second end of the upper arm.

14. The pliers of claim 10, wherein the engagement mechanism includes a pivotably supported pawl, and a shifter which is operable to transmit a locking and engaging force applied through the lower arm to the lower jaw and to engage the pawl to the support responsive to the movement of the jaw arm relative to the upper arm and responsive to the size of the workpiece grasped between the upper jaw and the lower jaw, wherein the shifter is pivotable relative to the jaw arm and is rotatable relative to the lower arm, and wherein the pawl is pivotably affixed to the shifter.

15. The pliers of claim 10, further including a locking mechanism that releasably engages and locks the jaw arm to the upper arm.

16. The pliers of claim 10, further including an overcenter locking engagement control movable between a first position whereat the overcenter lock switch mechanism does not prevent pivoting movement of the lower arm relative to the control arm prior to reaching an overcenter lock, and a second position whereat the overcenter lock switch mechanism does prevent pivoting movement of the lower arm relative to the control arm prior to reaching the overcenter lock.

17. The pliers of claim 10, further including a downwardly extending lobe on the control arm, and a release arm pivotably connected to the lower arm and having a release pad disposed to contact the lobe of the control arm when the release arm is pivoted.

18. The pliers of claim 10, further including an overcenter lock switch mechanism in the lower arm movable between a first position whereat the overcenter lock switch mechanism does not prevent pivoting movement of the lower arm relative to the control arm prior to reaching an overcenter lock, and a second position whereat the overcenter lock switch mechanism does prevent pivoting movement of the lower arm relative to the control arm prior to reaching the overcenter lock.

19. Pliers having upper and lower jaws to grasp a workpiece and upper and lower arms for grasping by the hand of a user, comprising:

the upper arm having a first end and a second end, wherein the upper jaw is at the first end of the upper arm;

the lower arm having a first end and a second end, wherein the lower arm is movable relative to the upper arm, and wherein the lower jaw is linked to the first end of the lower arm in movable facing relation to the upper jaw so that the workpiece may be grasped between the upper jaw and the lower jaw;

a control arm having a first end and a second end, wherein the first end of the control arm is pivotable relative to the upper arm, and wherein the second end of the control arm is pivotably connected to the lower arm; and an overcenter lock switch mechanism movable between a first position whereat the overcenter lock switch mechanism does not prevent pivoting movement of the lower arm relative to the control arm prior to reaching an overcenter lock position, and a second position whereat the overcenter lock switch mechanism does prevent pivoting movement of the lower arm relative to the control arm prior to reaching the overcenter lock position, and wherein the overcenter lock switch mechanism is further operable in the overcenter lock position to cause pivoting movement of the lower arm relative to the control arm out of the overcenter lock position.

20. Self-adjusting pliers having upper and lower jaws for grasping a workpiece and upper and lower arms for grasping by the hand of a user, comprising:

the upper arm having a first end integral with the upper jaw and a second end;

the lower arm having a first end linked to a jaw arm adjacent the lower jaw, but not integral with the jaw arm, and a second end;

the jaw arm having a first end integral with the lower jaw and a second end pivotally connected to the upper arm at a first pivot point adjacent to the second end of the upper arm such that the first end of the jaw arm and the first end of the lower arm are movable toward the upper jaw in circular arcs relative to the first pivot point up to an adjustable engagement position establishing a second pivot point adjacent the upper and lower jaws, the second pivot point transferring a closing force applied to the upper and lower arms to a closing force applied by the upper and lower jaws;

an engagement mechanism that establishes the engagement position in response to the size of the workpiece and closing of the upper and lower jaws upon the workpiece; and a support, integral with the upper arm and extending toward the lower jaw, that includes a slot, the engagement mechanism comprising a pawl positioned at least in part within the slot such that the pawl moves with the jaw arm within the slot and engages a surface of the slot to establish the engagement position, and the engagement mechanism further comprising a shifter connected to the pawl, the shifter being pivotably connected to the lower arm and the jaw arm and rotatable upon closing of the upper and lower jaws upon the workpiece to move the pawl against the surface of the slot to establish the engagement position.

21. The pliers of claim 20, further comprising a control arm having a first end pivotably connected to the lower arm and a second end pivotably connected adjacent the second end of the jaw arm such that the first end of the jaw arm, the first end of the lower arm and the first end of the control arm are movable as a unit toward the upper jaw and upper arm in circular arcs relative to the first pivot point up to the adjustable engagement position, the control arm thereafter controlling movement of the lower arm toward the jaw arm.

22. The pliers of claim 21, wherein movement of the control arm controls relative movement of the jaw arm and lower arm into and out of an overcenter lock position, and further comprising a switch having a first position enabling relative movement of the jaw arm and lower arm into the overcenter lock position and a second position preventing relative movement of the jaw arm and lower arm into the overcenter lock position.

* * * * *